United States Patent [19]

Eisenberg

[11] 4,103,720

[45] Aug. 1, 1978

[54] METHOD AND APPARATUS FOR FILLING CONTAINERS WITH LIQUID

[75] Inventor: Bernard C. Eisenberg, Rockaway, N.J.

[73] Assignee: Solbern Corp., Fairfield, N.J.

[21] Appl. No.: 734,667

[22] Filed: Oct. 21, 1976

[51] Int. Cl.[2] ..... B65B 3/26

[52] U.S. Cl. ..... 141/1; 141/86; 141/91; 141/124; 141/126; 141/131

[58] Field of Search ..... 134/102, 150; 137/192; 141/1, 54, 56, 70, 78, 85, 86, 89, 90, 93, 115, 121, 123-126, 131, 324, 87, 88, 91, 134, 164, 168, 171, 237, 280, 392, 69; 222/423, 564, 566

[56] References Cited

U.S. PATENT DOCUMENTS

| | | | |
|---|---|---|---|
| 1,072,405 | 9/1913 | Butcher | 137/192 |
| 2,939,614 | 6/1960 | Hill | 141/93 X |
| 3,217,760 | 11/1965 | Eisenberg | 141/78 X |
| 3,777,651 | 12/1973 | Hansen | 141/93 |

*Primary Examiner*—Richard E. Aegerter
*Assistant Examiner*—Frederick R. Schmidt
*Attorney, Agent, or Firm*—Kenyon & Kenyon, Reilly, Carr & Chapin

[57] ABSTRACT

Method and apparatus are disclosed for filling open-top containers with material capable of flowing such as liquid while preventing contamination of the container exteriors by liquid overflow. The containers are advanced along a predetermined path. The liquid is discharged towards the open tops of the containers to be filled in a substantially continuous sheet, descending adjacent the predetermined path. The containers are advanced beneath the liquid sheet with the containers tilted at a predetermined angle to the vertical. The tilted containers are overfilled and the overflowing liquid leaves the tops of the containers generally at the tilted lower top portions thereof. Streams of air are directed towards the tilted containers below the open tops thereof to cause the air to pass around the peripheries of the containers adjacent the container tops. The air flow prevents the liquid from escaping the open tops of the containers except substantially at the lower tilted top portions thereof, where the air flow causes overflowing liquid to be deflected away from the sides of the containers. The exterior of each container is thereby kept free of liquid.

46 Claims, 9 Drawing Figures

28
60
37
62
64
54
30b
58
30a
56
32
36
30
68
24
126
37
40
52
112
46
50
120
44
114
48
122
128
80
81
72
80
81
70
82
74
86
90
80
86
88
76
80
20
42
130
124

METHOD AND APPARATUS FOR FILLING CONTAINERS WITH LIQUID

BACKGROUND OF THE INVENTION

1. Field of the Invention

The invention relates to an apparatus and method for filling containers with liquids and the like and more particularly to an apparatus and method for filling moving containers to predetermined levels while maintaining the exterior of each container free of the liquid being filled.

2. Description of the Prior Art

Method and apparatus for filling containers with liquids are generally known in the art. Furthermore methods and apparatus (U.S. Pat. No. 2,785,706) are known for filling containers moving in a line with liquids while maintaining the sides of the containers free of the liquid during filling by mechanically deflecting liquid from falling between adjacent containers. Additionally, methods and apparatus are known to clean the overflowed material from the exterior of the container after filling. It is further known, as disclosed in U.S. Pat. Nos. 3,568,238, 2,200,100 and 766,510 to use air to remove liquid from the exterior of previously filled containers. In addition U.S. Pat. No. 3,537,447 discloses the use of air as a shield against liquid sprays and aerosols.

The known apparatus and methods which fill containers while maintaining the exteriors thereof free of liquid are relatively slow, complex and cumbersome and quite often involve the dispensing of a predetermined quantity of liquid directly into the open tops of stationary containers. The function of known apparatus and methods is non-continuous filling in the sense that the containers are not subjected to a free flow of liquid. Furthermore, where a predetermined quantity of liquid is dispensed per container in known methods and apparatus, it is necessary to sense the liquid level in the container, or meter the liquid, etc., thus adding complexity and cost to the system. Where high speed filling is desired, it has often been necessary to employ separate filling and cleaning apparatus and steps because of the time required to remove filling material from the exterior of the container as compared to the time required simply to fill the container. Thus a complete cleaning of the exterior of the containers has usually been required because of the quantity of material caused to contact the exterior of the containers during a high speed filling. Besides the expense of equipment and cleansing liquids to remove filling material from the exterior of the containers, there is added expense of the loss of costly liquid filling materials such as dissolved sugars, spices, etc. In addition the need of a washing procedure to remove materials from the exterior of the container results in the problem of disposing of the washing liquid which may have a high phosphate COD or BOD count.

In accordance with the present invention, these drawbacks and disadvantages of the prior art are obviated and additional advantages realized.

SUMMARY OF THE INVENTION

The present invention is embodied in and carried out by machines and methods for filling open-top containers with materials capable of flowing such as liquids (including sauce, brine, syrup, gravy and the like) while maintaining the exterior of the containers free of the material being filled. Thus, it is intended by use of the term "liquid" to include any material or combination of materials which can flow or which are fluid including pulverized, granular, or particulate materials, viscous liquids as well as the more fluid liquids including liquid solutions and mixtures containing solid particles therein, and mixtures of solid particles sufficiently moistened with a liquid to become fluid, and the like. In accordance with the present invention, a flow of material is formed descending toward a predetermined location, a container is placed adjacent the predetermined location with the open top thereof facing upwardly toward the descending flow of material, and at least one stream of fluid is directed toward the exterior of the container adjacent the open top portion thereof as at least a portion of the flow of material descends into the open top portion of the container, the stream of fluid being operative to deflect the flow of material away from the exterior of the upper portion of the container and to urge any material not entering the open top portion of the container or overflowing the container to travel laterally away from the exterior of the container without contacting the exterior of the container. In one embodiment of the invention, liquid to be filled is substantially continuously discharged in a flow along a first length in the form of a substantially continuous sheet of liquid, substantially juxtaposed containers having open tops are tilted at an angle to the vertical at least while below the liquid sheet and are advanced below and past the liquid sheet along a path parallel to the first length, and fluids such as air or other suitable gases are directed in a stream towards the tilted upper top portion of the containers such that the air stream passes about the periphery of the containers. The tilted containers and air stream are operative to prevent the liquid overflowing the containers from passing along the exterior portions thereof and further operative to direct the liquid overflowing the containers adjacent the lower portion of the tilted open tops of the containers to pass therefrom substantially in an arc extending away from the sides of the containers. It is believed that the air stream eliminates any negative pressure about the peripheries of the open tops of the containers and supports or tends to deflect any liquid overflowing the peripheries except at the lower portion of the tilted open tops from which the overflowing liquid is directed away. Preferably, the air is discharged towards the containers from a plurality of locations with a portion of the air directed upwardly towards the tops of the containers to prevent liquid overflowing the containers from passing along the sides thereof and to direct the overflowing liquid away from the containers. It is preferred that the air be discharged in streams having vertical and horizontal velocity components.

These and other aspects of the present invention will be more apparent from the following detailed description of the invention when considered with the accompanying drawing.

BRIEF DESCRIPTION OF THE DRAWING

The invention is illustrated by way of example and not limitation in the figures of the accompanying drawing in which like numerals refer to like parts and in which:

FIG. 3 is an end elevational view of the machine shown in FIG. 2;

DESCRIPTION OF THE PREFERRED EMBODIMENTS

Figure 1:
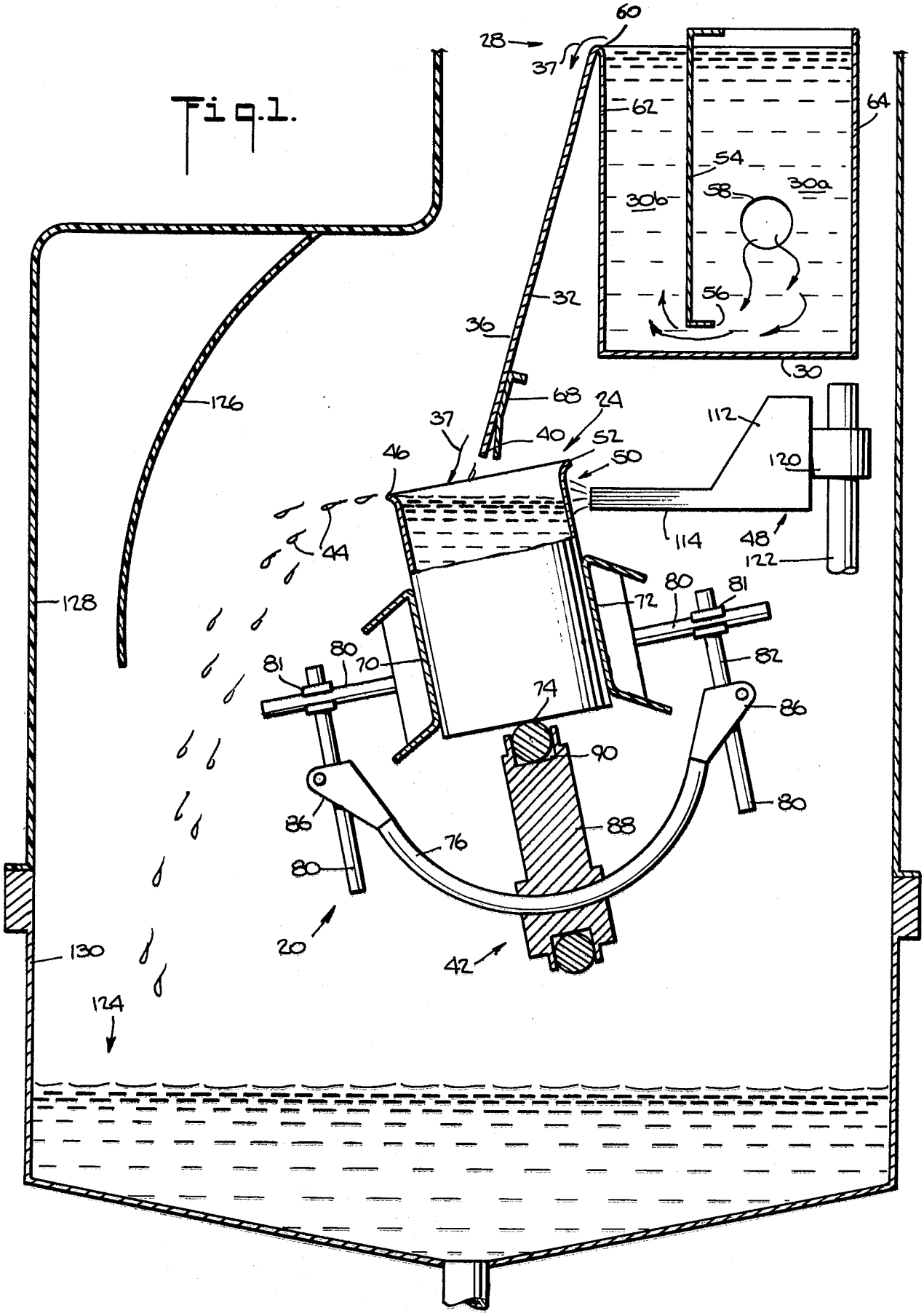
FIG. 1 is a vertical section view of the filling station of the machine of the invention.
Figure 1:
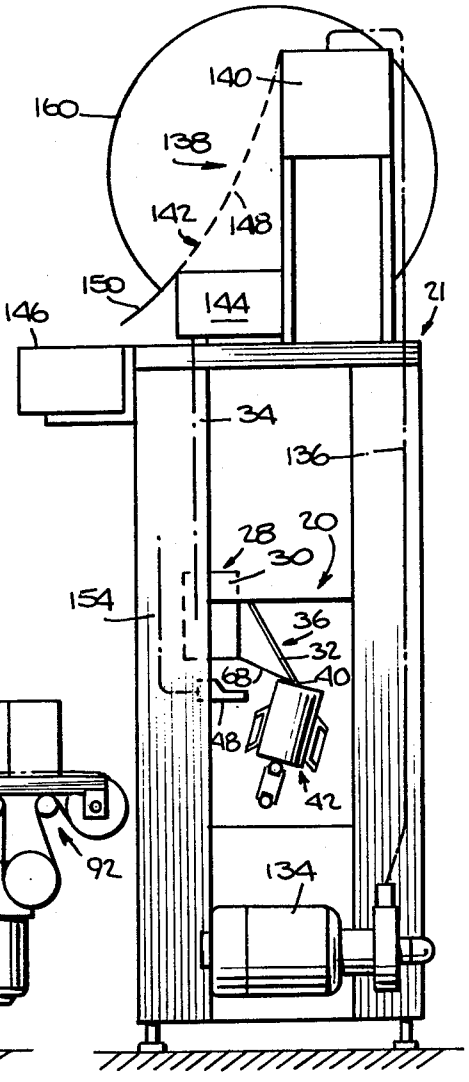
Figure 2:
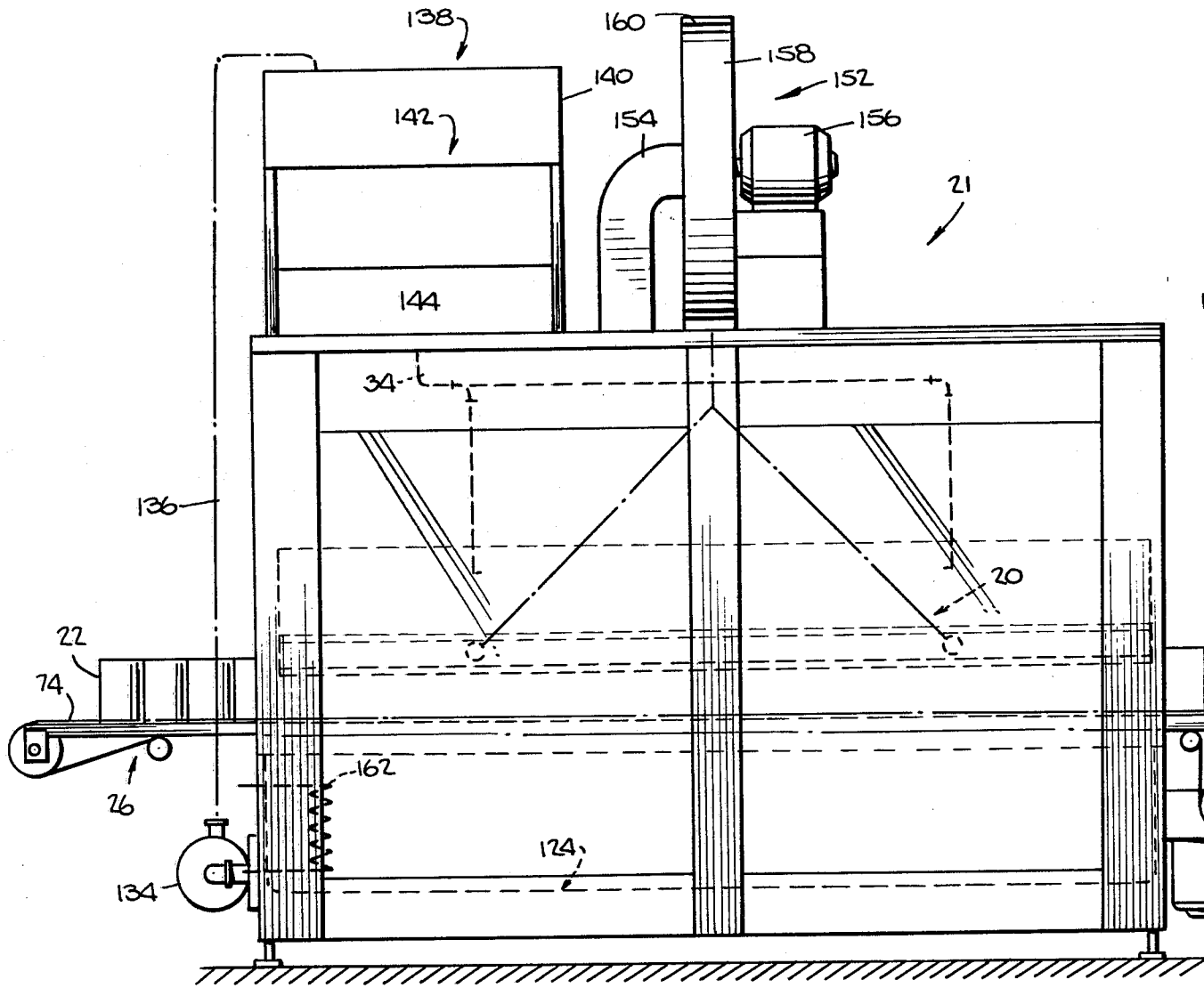
FIG. 2 is a side elevational view of the machine shown partially in FIG. 1.

Referring to FIGS. 1-3, the liquid filling station 20 of one embodiment of the filling machine 21 according to the invention is shown. Containers 22 in the form of cans having open tops 24 are advanced by chain conveyer 26 below and past a source of liquid, referenced generally by 28. Liquid source 28 includes weir 30 and inclined plate 32. Liquid to be filled is supplied to weir onto and down the inclined plate 32. The construction of the weir 30 and the delivery rate of liquid thereto is of a volumetric magnitude to cause the liquid level in the weir to overflow onto and down the inclined plate in the form of a liquid sheet 36 as shown by the arrows 37. Sides (not shown) are provided for the inclined plate 32 to retain the flowing liquid sheet 36 thereon until it is discharged from the inclined plate at its lower end 40.

As shown in FIG. 1, the open top containers 22 such as cans are advanced through the filling station 20, and the longitudinal axis or height of each container is tilted at an acute angle with the vertical and transversely with respect to the path of travel. The containers are advanced past and below end 40 of the inclined plate with the result that the liquid sheet 36 is discharged into the open tops 24 of the containers. A tilting assembly 42 operating in conjunction with the chain conveyer 26 tilts the containers as they are advanced below end 40 of the inclined plate. The volume of the liquid discharged in sheet 36 and the speed at which the containers 22 are advanced therebelow are selected in order that the containers are overfilled and liquid 44, shown as droplets, over-flows the containers. Tilting the containers at a preselected angle with the vertical while filling serves two purposes. The first purpose is to provide a predetermined headspace or clearance above the filling material in the container after the filled container has been righted. The second purpose is that filling the containers tends to direct or channel the overflowing liquid towards the lower portion 46 of the tilted top. This channeling effect reduces the quantity of liquid which would otherwise overflow the container tops about the peripheries thereof and which could attempt to run down the sides of the containers.

Figure 6:
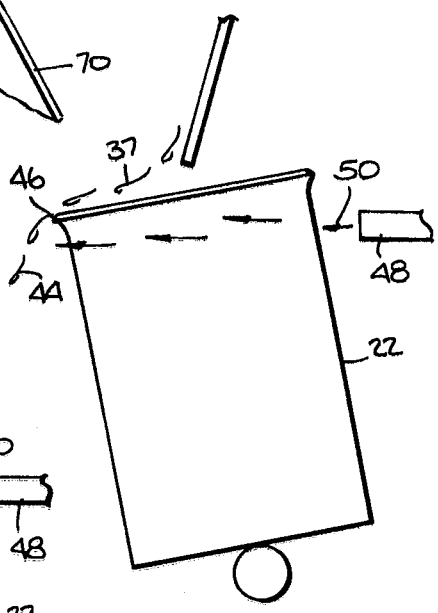
FIG. 6 is a fragmentary vertical section view of the machine showing the flow of material with respect to the exterior of the container.
Figure 7:
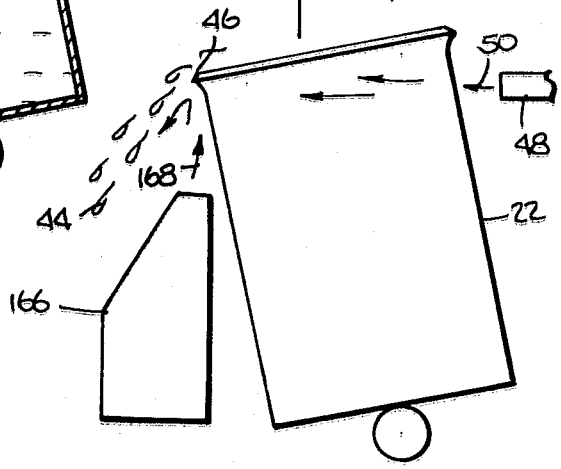
FIG. 7 is a fragmentary vertical section view of the machine of the invention showing the flow of the material from the container.

To insure that there is no running or dripping of liquid along the sides of the containers, air knife assembly 48 directs a substantially horizontal stream of air 50 towards the exterior of the top portion of the containers adjacent the upper portion 52 of the tilted tops. The stream of air flows around the peripheries of the containers toward the tilted lower tops 46. The air stream is shown more clearly in FIG. 4 with respect to jar containers, the stream being referenced by 53. The action of the air stream about the container peripheries and the channeling action of the overflowing liquid 44 toward the lower portion 46 of tilted tops caused by tilting of the containers serves to prevent any liquid from overflowing the container tops except at the lower portion 46. (FIG. 1) Additionally, the air stream, liquid flow 44, and tilting of the containers are operative to discharge the overflowing liquid away from the containers such that there is no overflow along the container sides, as best shown in FIGS. 6 and 7.

Referring more particularly to FIG. 1, liquid source 28 is shown comprising weir 30 and inclined plate 32. A baffle 54 is vertically disposed in weir 30 to separate the weir into two compartments 30*a* and 30*b*. Baffle 54 extends into the weir to adjacent the bottom thereof, leaving passage or space 56 to communicate with compartments 30*a* and 30*b*. Liquid to be supplied to containers 22 is discharged into weir 30 by conduit 34 (FIG. 3) which has a horizontally disposed discharge orifice 58 positioned within compartment 30*a* (FIG. 1). Baffle 54 extends above the curved junction 60 of the inclined plate 32 and the weir front wall 62 to a height as high as rear wall 64 of the weir. As a result, the liquid level in the weir 30 is determined by the height of the weir front wall 62. With this arrangement, the liquid rises to the height of junction 60 and overflows onto and down inclined plate 32 as sheet of liquid 36. It is desireable to have a substantially smooth sheet 36 of liquid discharged by inclined plate 32, as splashing or spraying or other turbulent discharge of liquid would be detrimental to channeling of the overflowing liquid towards the lower portions 46 of the tilted tops of the containers as described hereinbefore. A smooth non-turbulent overflow of liquid from weir 30 to inclined plate 32 assists in producting a smooth liquid sheet 36. This non-turbulent overflow is acomplished by isolating any turbulence caused by the discharge of liquid into compartment 30*a* from the overflow thereof from compartment 30*b* by baffle 54. Additionally, to reduce turbulence, discharge orifice 58 is disposed horizontally and below the liquid level in compartment 30*b* and spaced above the passage 56 communicating compartments 30*a* and 30*b*. Accordingly, there is a settling effect as the liquid passes under baffle 54 before rising in compartment 30*b*.

Inclined plate 32 extends downwardly from juncton 60 and away from wall 62 at an angle with the vertical whose value is determined by parameters such as the nature of the material or liquid, size of a container, and filling speed and is suitably in the range between about 10 to about 45 degrees. By way of example, when the liquid is brine, the angle may be about 15°. The inclined plate has a lower end 40 which is formed by the junction thereof with plate 68. The junction as shown in FIG. 1 is in the form of an inverted "V-shape" to prevent the flow of liquid upwardly along plate 68 and plate 68 extends upwardly adjacent end 40 at a sufficiently steep angle for this purpose. Alternatively, incline plate 32 may form a V-shape junction at 40 extending upward at a sufficiently steep angle as shown in FIG. 3 for the same reason of preventing the flow of liquid upwardly along plate 68 after it has turned about end 40.

Now referring again to FIG. 1, the tilting assembly 42 is shown to include opposed guide rails 70, 72 for guiding and supporting the containers 22 together with links 74 of conveyor 26 at any desired angle within predetermined limits as the containers are advanced past the filling station 20 in the tilting assembly 42. Each guide rail 70, 72 is mounted on opposed ends of arcuate spaced-apart yokes 76 by means of posts 80 which are adjustly secured at the opposite ends of the guide rails by clamps 81. Each of the posts is releasably secured by the respective clamp to be slidably movable therein for preselected adjustment of the vertical position of the guide rails as well as adjustment of the spacing between the guide rails. Clamps 81 permit two direction adjustment, posts 80 being movable therein. Thus, the positions of the rails may be adjusted to accommodate containers of varying height and diameter or thickness. The spaced yokes 76 are slidably supported by and through track 88. Adjustment of the tilt angle is made by adjusting the position of the yokes with respect to the track 88. Further details of the structure and operation of the tilting assembly are shown and described in my prior U.S. Pat. No. 3,903,941 which is hereby incorporated herein by reference.

Other means such as those disclosed in my aforementioned patent and hereinafter may also be used to tilt and vary the angle at which the containers are advanced past the inclined plate 32. Additionally, it may be desirable to vibrate the containers to release entrapped air therein or to settle or consolidate any solid material in the containers, and structure for accomplishing this is also disclosed in my aforementioned patent.

As best shown in FIGS. 1 and 2, the containers 22 are advanced by chain conveyor 26 through frictional engagement of the links 74 with the bottom of the containers. The conveyor is movably supported partially in channel 90 by the assembly rail 88. Means such as sprockets and motors for moving the chain are shown in FIG. 2 and referenced generally by 92. Preferably, the means include a variable speed drive. Further details of chain conveyors are known in the art. The containers are advanced vertically disposed on the conveyor towards tilting assembly 42 whereafter they are tilted by the assembly and advanced away therefrom again vertically disposed.

Figure 4:
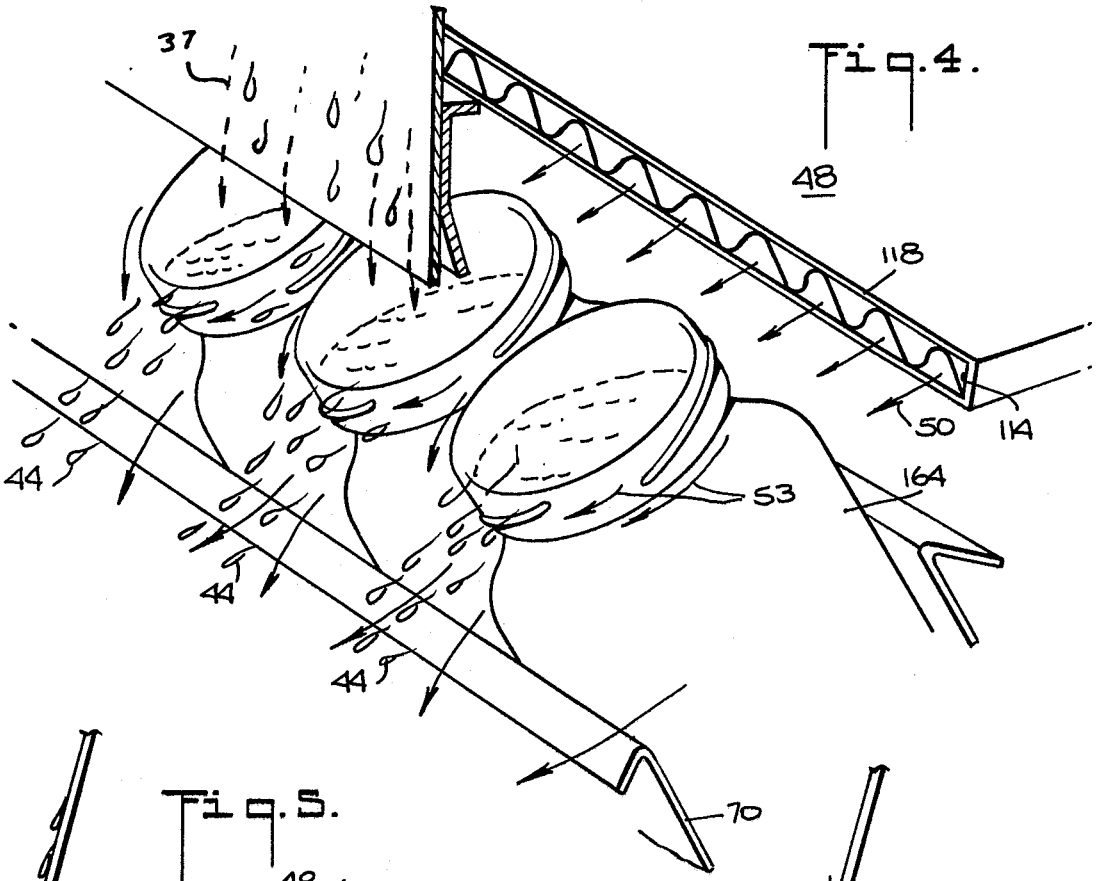
FIG. 4 is a perspective view partly in section and partly broken away, of a machine filling station according to the invention showing containers being filled.

Referring now to FIGS. 1 and 4, air knife 48 comprises a distribution chamber 112 and an elongated nozzle 114. Air or other suitable gases are supplied under pressure to the chamber by conduit 154 and exit the nozzle 114 in a substantially horizontally directed stream 50. It is highly desirable to have a smooth nonturbulent delivery of air in order that the air stream may be directed in a desired direction. Additionally, a nonturbulent air flow reduces any tending of the air flow to diverge and can be more easily directed around the peripheries of the containers. To further reduce turbulence and provide a substantially straight, forceful stream of air, sheet corrugations 118 are positioned in nozzle 114 (FIG. 4). Air knife 48 is adjustable mounted by means of rods 122 and clamps 120 (only one set being shown in FIG. 1), the clamps being rigidly secured to the exterior of chamber 112 and releasably secured to the rods for adjustment therealong. Accordingly, the height of the air knife can be adjusted.

Referring now again to FIGS. 2 and 3, side and end views of the overall machine including filling station 20 according to the invention are shown. The containers 22 to be filled are advanced (left-to-right in FIG. 2) towards the filling station 20 on conveyor 26 (guide sections not being shown for clarity). Filling station 20 includes a catch basin 124 (portions of which are shown in FIG. 1) over which the containers are advanced during filling whereby the liquid overflow is collected in the catch basin. An arcuate spray screen 126 (FIG. 1) is provided to prevent any liquid overflow carried by the air stream 50 from leaving the space above the catch basin. Any liquid which strikes the screen 126 will be deflected downwardly to be collected by the catch basin. An additional shield 128 (FIG. 1) is provided extending above the side 130 of the catch basin opposed to the flow of air from air knife 48 also to prevent the escape of any liquid overflow. The arcuate screen 126 and shield 128 are advantageously made of a transparent resin or glass material in order to afford the machine attendant a view of the filling station. Preferably, the shield 128 extends up above the liquid source 28 and also around a portion of the sides of the catch basin.

The liquid collected in the catch basin is recirculated as shown in FIGS. 2 and 3 to weir 30 by pump 134 through conduit 136 (shown schematically), filter assembly 138 and conduit 34. Filter assembly 138 comprises weir 140, a self-cleaning filter screen 142, filtrate tank 144 and waste collection tank 146. The overflowed liquid to be recirculated is pumped from catch basin 124 to filter assembly weir 140 and is permitted to overflow therefrom onto arcuate filter screen 142. Waste and impurities are removed from the liquid by retention on the central portion 148 of the screen while the liquid filtrate passes therethrough to be collected by filtrate tank 144 placed below the central portion 148 of the screen. The retained waste flows down screen 142, which is sloped away from the weir 140, and is collected by waste tank 146 positioned below solid end portion 150 of the screen. The liquid to be recirculated flows from tank 144 through conduit 34 to liquid source 28. A fresh supply of liquid is also fed to liquid source 28 by known means which are not shown.

Air is supplied to air knife 48 by pressure blower 152 and conduit 154 (FIG. 2). The pressure blower comprises motor 156 and fan 158 enclosed in fan enclosure 160. A heat exchanger coil 162 shown schematically can be provided to control the temperature of the material or liquid in the catch basin.

Figure 5:
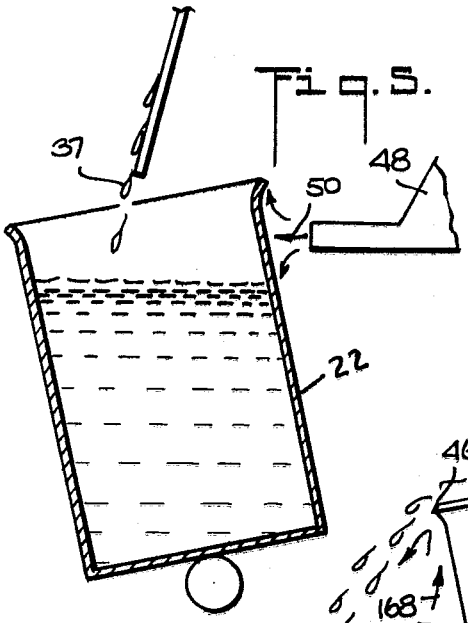
FIG. 5 is a fragmentary vertical section view of the machine of the invention and a container showing the flow of material into the container.

Referring to FIGS. 4–7, the flow of liquid and air is more clearly shown. In FIG. 5, liquid desends into unfilled container 22 and is unaffected by air stream 50 which passes about the periphery of the container. In FIG. 6, the container is full and liquid overflows therefrom concentrated at the tilted lower top portion 46 away from the exterior sides of the container. Air stream 50 directed about the periphery of the container top prevents the liquid 44 from overflowing the container except concentrated at lower top portion 46. In FIG. 7, a vertical air knife 166 is provided to assist in keeping liquid 44 away from the exterior side of container 22. Air stream 168 is directed towards lower top portion 46 to accomplish this. FIG. 4 shows the air flow about the peripheries of jars 164 referenced by solid-lined arrows, the liquid flow 37 of inclined plate 32 being referenced by broken-lined arrows. The liquid 44 is shown overflowing the jars concentrated at lower top portion 174. Air stream 50, 53 keeps the overflowing liquid 44 away from the exterior sides of the jars.

The foregoing description of embodiments of the invention have been made using cans in which the tops thereof are shown abutting and jars; however, the can tops need not be abutting. Other containers such as bottles, cups, etc. can be filled by the machine and method of the invention.

Figure 8:
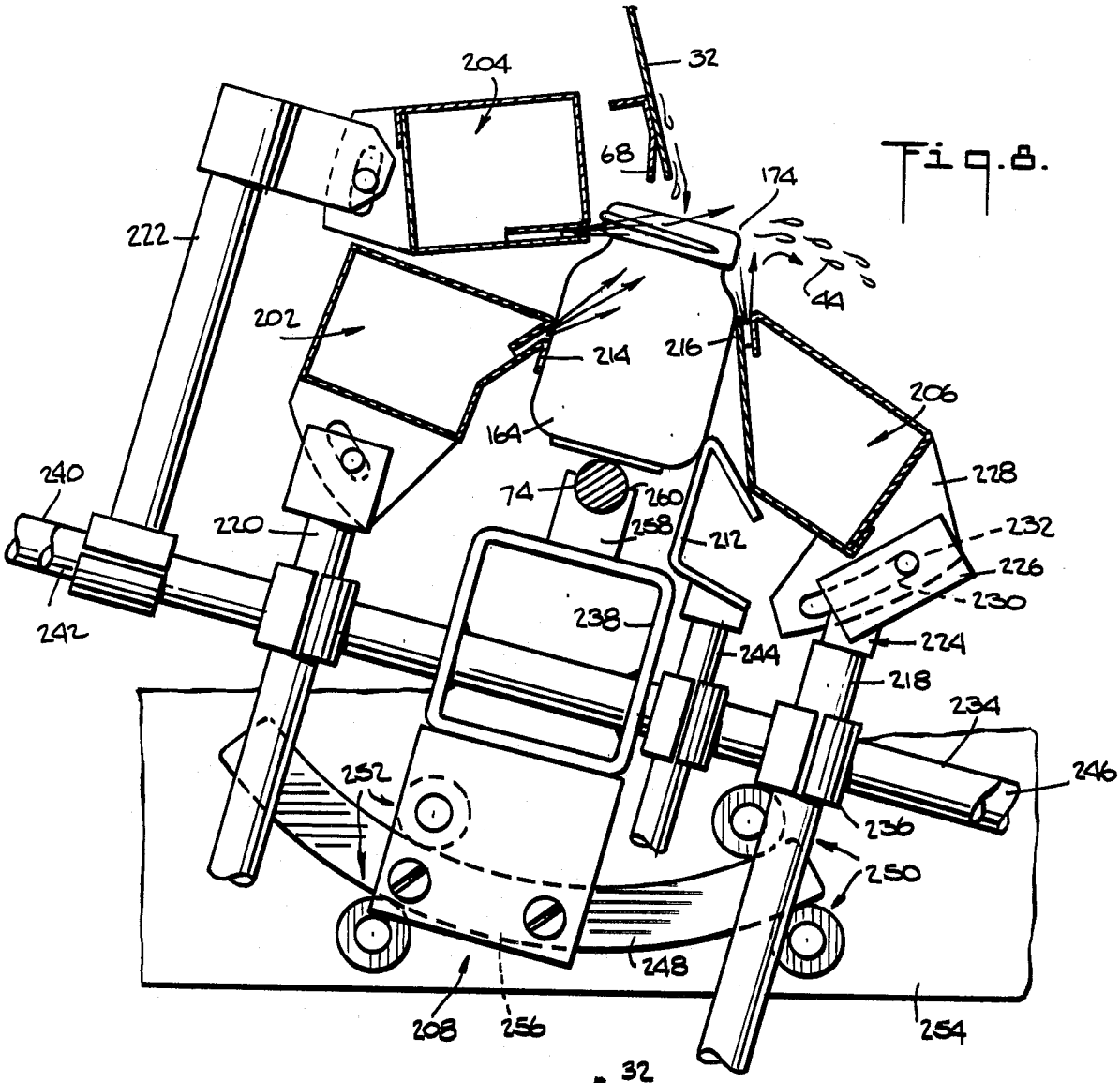
FIG. 8 is a fragmentary vertical section view of a preferred embodiment of a machine filling station according to the invention showing three air knives and a container being filled.
Figure 9:
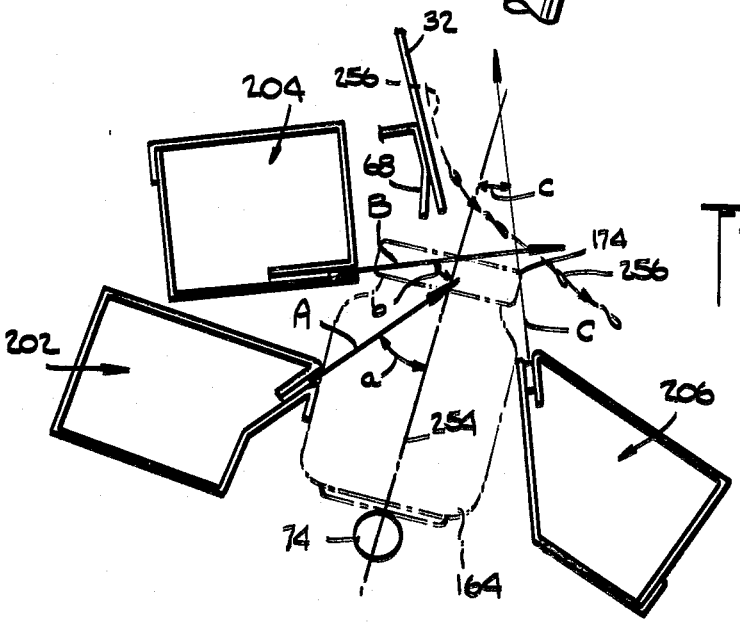
FIG. 9 is a fragmentary vertical section view showing the air and liquid flow of the preferred embodiment of FIG. 8.

A preferred embodiment of the invention for filling jars and cans using three air knives 202, 204 and 206 is shown in FIGS. 8 and 9. Referring to FIG. 8, a side view of the air knives and support structure therefor and of tilting assembly 208 are shown. The view shown in FIG. 8 is similar to the view of FIG. 2 in that portions are shown in secton and only one set of supports for the guides and air knives is shown. Jars 164 are supported in part and advanced by conveyor support member 74 and also supported in part and guided by guide 212 and guides 214 and 216 associated with air knives 202 and 206, respectively.

The air knives and guide 212 are adjustably supported so as to be operable with jars of varying height and diameter. Each air knife is pivotably mounted on a respective rod 218, 220, 222. Referring to air knife 206, it is mounted on rod 218 by means, such as clamp 224 which includes bracket 226. Air knife 206 includes a bracket 228 having a slot 230 therein and is pivotably secured to bracket 226 through slot 230 by means such as bolt 232 threadedly secured in bracket 226 whereby the air knife is locked in preselected pivoted positions. Clamp 224 secures air knife 206 to rod 218 and rod 218 is releasably secured to rod 234 by means such as clamp 236. Rod 234 is rigidly secured to conveyor channel member 238 of tilting assembly 208. The positions of air knife 206 and guide 216 are adjustable in two directions by means of clamp 236 to accommodate varying height and diameter jars as well as being pivotably adjustable along slot 230. Air knives 202 and 204 are similarly supported by brackets, clamps and rods, each rod 220, 222 being secured to separate rods 240, 242, respectively, which are secured to channel member 238 in known manner. Guide 212 is also supported in this manner by brackets and clamps on rods 244 and 246 (guide 212 not being pivotable with respect to rod 244).

Still referring to FIG. 8, tilting assembly 208 includes yokes 248 (as mentioned hereinbefore, only one half of the assembly is shown and, accordingly, only one yoke is shown). Yokes 248 are movably supported between roller pairs 250, 252 the rollers being supported by machine frame 254. Channel member 238 is secured to yokes 248 to move therewith through L-brackets 256 by fasteners such as screws. On conveyor channel member 238 is secured conveyor rail 258 which in turn supports in arcuate channel 260 thereof for slidable movement therein conveyor support member 74. By virtue of the connection of the channel member 238 to yokes 248 and the connection of the air knives and guides to the channel member through rods 234, 240, 242 and 246 (and the counterparts thereof which are not shown), the air knives, guides and conveyor support member 74 are tiltable as an assembly. This permits the selection and use of any tilt angle in the range without the necessity of readjusting any of the air knives or guides. The assembly 208 is maintained in a selected position in known manner by stop means (not shown) associated with the yokes and/or roller pairs.

The air flow and liquid overflow patterns using the three air knife embodiment are shown in both FIGS. 8 and 9. Referring to FIG. 9, the longitudinal axis of the air streams being discharged from air knives 202, 204 and 206 are referenced, respectively, by A, B, C, and the tilted axis of the jars by 254. Each air stream axis interests the jar axis at an angle, these angles being referenced by "*a*", "*b*" and "*c*" are dependent upon the characteristics of the air stream discharged from the air knives, the angle at which the jars or other containers are tilted, the configuration of the jars or other containers, and the characteristics and flow of the liquid being filled. The air from knives 202 and 204 passes about the peripheries of the tops of the jars and prevents any liquid 44 from overflowing or splashing over and down along the jar peripheries except at the lower tilted top 174 as described hereinbefore. The air from knife 206 passes along and over the peripheries of the lower tilted top 174 to prevent the liquid from overflowing down the jar side below lower top portion 174. Accordingly, the liquid arcs away from the jars as shown in FIG. 9. The air from knives 202 and 206 passing about the peripheries of the jar tops intersects and assists the air from knife 206 in "arcing" the overflowing liquid away from the lower tilted side. FIG. 9 shows the liquid flow 256 which results from the configuration of FIG. 8 with the jars removed, a jar being shown in phantom for orientation purposes. The direction, force and intersecton of the air streams, as shown, support or tend to support the liquid being discharged from the inclined plate and prevent the liquid from falling vertically into the space normally occupied by the jars and also to cause the liquid to move horizontally as well as vertically, thereby causing the liquid to move angularly away from the space between the air knives.

In the preferred embodiment of FIGS. 8 and 9, the air streams comprise both horizontal and vertical velocity components. The air streams from knives 202 and 206 comprise a dominant vertical velocity components, and that from knife 204 comprises a dominant horizontal velocity component.

While the means for supporting and adjusting the air knives, guides and tilting assembly have been disclosed to be rods, yokes, clamps, etc., it is to be understood that other adjustable supporting means (or fixed supporting means where adjustment is unnecessary) may be employed without departing from the spirit and scope of the invention. In this respect, the supporting means may be made adjustable through driving systems, such as chain and sprocket drives. Additionally, inclined plate 32 and weir 30 have been shown to be non-adjustable. The angle of inclined plate 32 may be made adjustable by, for example, hinging portions of the inclined plate or hinging the inclined plate to the weir, and weir 30 may be supported for adjustable vertical movement.

In accordance with the invention, parameters such as angles, filling speed, air pressure and direction will vary to suit the particular filling application at hand. For a particular machine, the ranges of suitable values and the optimum valves for such variable as: tilt angle; air pressure volume and velocity; volume (length, width, thickness), speed and angle of delivery of liquid; speed of movement of containers; are interdependent and also depend upon other variables such as liquid type, container size and configuration. These valves are simply and readily determined by use of the machine with the particular liquid and the particular container combination to be processed.

The advantages of the present invention, as well as certain changes and modifications of the disclosed embodiment thereof, will be readily apparent to those skilled in the art. It is the applicant's intention to cover by his claims all those changes and modifications which could be made to the embodiment of the invention herein chosen for the purposes of the disclosure without departure from the spirit and scope of the invention.

What is claimed is:

1. A method for filling a container with a material capable of flowing while maintaining the exterior of the container free of the material, the container having an open top portion and a side portion at the exterior thereof adjacent the open top portion, comprising:

(a) forming a flow of material descending toward a predetermined location, the extent of the descending flow adjacent the predetermined location being exposed;

(b) placing the container adjacent the predetermined location with the open top portion thereof facing upwardly toward the exposed extent of the descending flow of material and being in the path of flow thereof, the side portion of the container being exposed when the container is placed adjacent the predetermined location; and (c) directing at least one stream of fluid toward the exposed side portion of the container adjacent the open top portion thereof as at least a portion of the exposed extent of the descending flow of material flows into the open top portion of the container, the stream of fluid directed toward the exposed side portion of the container being diverted by the exposed side portion to flow about the container and away thereform, the stream of fluid being operative to deflect the exposed extent of the descending flow of material not entering the open top portion of the container away from the side portion at the exterior of the container adjacent the top portion thereof and to urge any material overflowing the container to move laterally away from the open top portion of the container without contacting the exterior of the container.

2. The method of claim 1, wherein the flow of material is formed to descend in a sheet toward the predetermined location.

3. The method of claim 1, wherein the step of placing the container adjacent the predetermined location comprises moving the container through the predetermined location.

4. The method of claim 1, wherein the container placed adjacent the predetermined location has the open top portion of the container tilted substantially in the direction of the stream of fluid with the higher edge of the open top portion facing the stream of fluid.

5. The method of claim 1, wherein the flow of material comprises a liquid.

6. The method of claim 1, and further comprising the steps of receiving the material not entering or overflowing the container and returning such material to be again formed into a flow of material to be descended toward the predetermined location.

7. The method of claim 1, and further comprising selectively controlling the rate of flow of material and the rate of movement of the at least one stream of fluid.

8. The method of claim 1, wherein the stream of fluid directed toward the exterior of the container consists essentially of air.

9. A method for filling open-top containers with a liquid while maintaining the exterior of the container free of the liquid comprising the steps of:

(a) discharging the liquid in a substantially continuous sheet along a first length;

(b) advancing the containers tilted transversely with respect to the first length and at an angle with the vertical at least along a path below and substantially parallel to the first length, the containers being advanced and the liquid being discharged into the containers to overflow therefrom substantially from proximate the lower portion of the tilted tops of the containers; and (c) directing air in at least one stream towards the containers from below at least the upper portion of the tilted tops of the containers to pass at least about the peripheries of the containers approximately below and adjacent the tops thereof, the air being operative to prevent the liquid overflowing the containers from flowing along the exteriors thereof.

10. The method of claim 9, wherein the at least one stream of air is directed towards the containers for at least the first length.

11. The method of claim 10 wherein the first length is linear.

12. The method of claim 10, wherein the at least one stream of air and the tilting of the containers are further operative to direct the liquid overflowing the containers towards the lower portion of the tilted tops thereof to overflow therefrom substantially away from the lower portion of the tilted tops of the containers.

13. The method of claim 10, wherein the at least one stream of air is directed substantially horizontally towards the containers from below the upper portion of the tilted tops of the containers.

14. The method of claim 10, wherein the at least one stream of air is directed substantially horizontally from at least below the upper portion of the tilted tops of the containers and substantially vertically from at least below the lower portion of the tilted tops of the containers.

15. The method of claim 10, wherein the air is directed in a plurality of streams in a plurality of directions.

16. The method of claim 15, wherein the plurality of air streams comprise substantially only horizontal components.

17. The method of claim 15, wherein the plurality of air stream comprise horizontal and vertical components.

18. The method of claim 9, wherein the air is directed toward the exterior of the containers in three streams, a first air stream directed from below the lower portion of the tilted tops of the containers and having a dominant vertical velocity component, a second air stream directed from below the upper portion of the tilted tops of the containers and having a dominant vertical velocity component, and a third air stream directed from below the upper portion of the tilted tops of the containers and having a dominant horizontal velocity component.

19. A machine for filling a container with a material capable of flowing while maintaining the exterior of the container free of the material, the container having an open top portion and a side portion at the exterior thereof adjacent the open top portion, comprising:

(a) means for forming a flow of material descending toward a predetermined location the extent of the descending flow adjacent the predetermined location being exposed;

(b) means for supporting a container adjacent the predetermined location with the open top portion thereof facing upwardly toward the exposed extent of the descending flow of material and being in the path of flow thereof, the side portion of the container being exposed when the container is placed adjacent the predetermined location; and (c) means for directing at least one stream of fluid toward the exposed side portion of the container adjacent the open top portion thereof as at least a portion of the exposed extent of the descending flow of material flows into the open top portion of the container, the stream of fluid directed toward the exposed side portion of the container being diverted by the exposed side portion to flow about the container and away therefrom, the stream of fluid directed by the directing means being operative to deflect the exposed extent of the descending flow of material not entering the open top portion of the container away from the side portion at the exterior of the container adjacent the top portion thereof and to urge any material overflowing the container to move laterally away from the open top portion of the container without contacting the exterior of the container.

20. The machine of claim 19, wherein the forming means is elongated and operative to form a flowing sheet of material to descend toward the predetermined location.

21. The machine of claim 19, wherein the supporting means includes means for moving the container through the predetermined location.

22. The machine of claim 19, wherein the supporting means includes means for tilting the open top portion of the container substantially in the direction of the stream of fluid with the higher edge of the open top portion facing the stream of fluid.

23. The machine of claim 19, wherein the forming means forms a flow of material comprising at least one liquid.

24. The machine of claim 19, and further comprising means for receiving the material not entering or overflowing the container and returning means for returning such material to be again formed into a flow of material to be descended toward the predetermined location.

25. The machine of claim 19, wherein the flow forming means includes means for controlling the rate of flow of material.

26. The machine of claim 19, wherein the directing means includes means for controlling the rate of flow of the at least one stream of fluid.

27. The machine of claim 19, wherein the stream of fluid directed toward the exterior to the container consists essentially of air.

28. A machine for filling open-top containers with a liquid while maintaining the exterior of the containers free of the liquid comprising (a) means for discharging the liquid in a substantially continuous sheet along a first length;

(b) means for advancing the containers at least along a path below and substantially parallel to the first length operative to permit discharge of the liquid into the moving containers;

(c) means for tilting the containers transversely with respect to the first length and at an angle with the vertical at least while they are advanced below the first length, the liquid overflowing the containers while they are tilted; and (d) means for directing air toward the containers for at least the first length from below at least upper portions of the tilted tops of the containers operative to pass about at least the peripheries of the containers approximately below and adjacent the tops thereof, the air being operative to prevent the liquid overflowing the containers from flowing along the exteriors of the containers.

29. The machine of claim 28, wherein the discharging means includes a planar discharge part for discharging the liquid in a linear sheet along the first length.

30. The machine of claim 24, wherein the discharging means further includes a weir and a planar inclined plate secured to the top of one side thereof and sloping downwardly such that overfilling of the weir causes a sheet of liquid to overflow from the weir onto the inclined plate.

31. The machine of claim 28, wherein the tilting means and air means are further operative to direct the liquid overflowing the containers towards the lower portion of the tilted tops thereof to overflow therefrom substantially away from the lower portion of the tilted tops of the containers.

32. The machine of claim 28, wherein the air means comprises at least one elongated source directing air substantially horizontally from below the upper portion of the tilted tops of the containers.

33. The machine of claim 28, wherein the air means comprises at least one elongated air source directing air substantially horizontally from below at least the upper portion of the tilted tops of the containers and at least one elongated air source directing air sustantailly vertically from at least below the lower portion of the tilted tops of the containers.

34. The machine of claim 28, wherein the air means comprises a plurality of elongated air sources directing air in at least one stream having vertical and horizontal velocity components.

35. The machine of claim 34, wherein the air means comprises three elongated air sources, a first air source directing air from below the lower portion of the tilted tops of the containers in a stream having a dominant vertical velocity component, a second air source directing air from below the upper portion of the tilted tops of the containers in a stream having a dominant vertical velocity component, and a third air source directing air from below the upper portion of the tilted tops of the containers in a stream having a dominant horizontal velocity component.

36. The machine of claim 28, wherein the advancing means comprises a conveyer.

37. The machine of claim 28, wherein the tilting means comprises an angularly adjustable tilting assembly including positionally adjustable guide means secured to the tilting assembly movable therewith and adjustable independent thereof.

38. The machine of claim 27, wherein the air means includes means for vertically and horizontally positioning the discharging of the air therefrom secured to the adjustable tilting assembly.

39. The machine of claim 28, wherein the air means includes means for vertically and horizontally positioning the discharging of the air therefrom.

40. The machine of claim 28, wherein the air means includes means for vertically, horizontally and angularly positioning the discharging of the air therefrom.

41. A machine for filling moving open-top containers with liquid while maintaining the exterior of the containers free of liquid comprising:

(a) a weir and a planar inclined plate connected thereto at the top of one side thereof and sloping downwardly therefrom operative to form and discharge a substantially continuous sheet of liquid upon overfilling the weir with liquid whereby the liquid overflows the weir onto the incline plate;

(b) conveyer means for advancing the containers below and parallel to the liquid sheet being discharged from the incline plate operative to permit the discharge of the liquid into the moving containers;

(c) adjustable tilting assembly means for tilting the containers at least while they are advanced below the liquid sheet being discharged, the liquid overflowing the containers while they are tilted; and (d) at least one elongated air source for directing air towards the containers for at least the length of the incline plate from below at least the upper portion of the tilted tops thereof operative to pass the air about at least the periphery of the containers approximately below and adjacent the tops thereof, the air being operative to prevent the liquid overflowing the containers from flowing along the exterior thereof.

42. The machine of claim 41, wherein the at least one air source directs air in a stream having a dominant horizontal velocity component.

43. The machine of claim 41, and further comprising a plurality of elongated vertical air sources for directing air towards the containers from below at least the upper portion of the tilted tops thereof in streams having horizontal and vertical velocity components.

44. The machine of claim 41, wherein the at least one air source comprises a first air source positioned below the tilted lower portion of the tilted tops of the containers and a second and a third air source positioned below the upper portion of the tilted tops of the containers, the first air source directing air in a stream having a dominant vertical velocity component, the second air source directing air in a stream having a dominant horizontal velocity component, and the third air source directing air in a stream having a dominant vertical velocity component.

45. The machine of claim 44, wherein the first air source is positioned opposed to the second and third air sources.

46. A method for filling a container having an open top portion with a material capable of flowing while maintaining the exterior of the container free of the material comprising:

(a) forming a flow of material descending toward a predetermined location, the extent of the descending flow adjacent the predetermined location being exposed;

(b) placing the container adjacent the predetermined location with the open top thereof tilted and facing upwardly toward the exposed extent of the descending flow of material; and (c) directing streams of fluid toward the exterior of the container adjacent the open top portion thereof as at least a portion of the exposed extent of the descending flow of material descends into the open top portion of the container, the streams of fluid being operative to deflect the exposed extent of the descending flow of material away from the exterior of the upper portion of the container and to urge any material not entering the open top portion of the container or overflowing the container to travel laterally away from the exterior of the container without contacting the exterior of the container, the directing of the streams of fluid including the directing of three streams of fluid toward the exterior of the container, in a first stream directed from below the tilted top of the container and having a dominant vertical velocity component, a second stream directed from below the tilted top of the container on the side of the container opposite that at which the first stream is directed and having a dominant vertical velocity component, and a third stream directed from below the tilted top of the container and having a dominant horizontal velocity component.

* * * * *

UNITED STATES PATENT AND TRADEMARK OFFICE

CERTIFICATE OF CORRECTION

PATENT NO. : 4,103,720

DATED : August 1, 1978

INVENTOR(S) : Bernard C. Eisenberg

It is certified that error appears in the above-identified patent and that said Letters Patent are hereby corrected as shown below:

Column 3, line 57, delete "filling" and insert --tilting--

Column 4, line 26, after "height" insert --at least--

Column 4, line 40, delete "acomplished" and insert --accomplished--

Column 4, line 49, delete "juncton" and insert --junction--

Column 7, line 9, delete "secton" and insert --section--

Column 8, lines 20-21, delete "intersecton" and insert --intersection--

Column 12, line 25, delete "substantailly" and insert --substantially--

Column 9, line 26, delete "thereform" and insert --therefrom--

Column 11, line 47, delete "to" and insert --of--

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*